US005743130A

United States Patent [19]

Erath et al.

[11] Patent Number: 5,743,130

[45] Date of Patent: Apr. 28, 1998

[54] APPARATUS FOR INSTALLING EXPANSIBLE ANCHORS

[75] Inventors: Herbert Erath, Waldachtal; Christian Schmid, Schopfloch-Oberiflingen, both of Germany

[73] Assignee: fischerwerke Artur Fischer GmbH & Co. KG, Waldachtal, Germany

[21] Appl. No.: 676,425

[22] Filed: Jul. 8, 1996

[30] Foreign Application Priority Data

Jul. 6, 1995 [DE] Germany ..... 195 24 610.5

[51] Int. Cl.[6] ..... B21J 15/10; B21J 15/18

[52] U.S. Cl. ..... 72/391.4; 72/453.15; 29/524.1

[58] Field of Search ..... 29/524.1, 525.02, 29/243.519, 243.53; 72/391.2, 391.4, 391.6, 391.8, 114, 453.15, 453.17

[56] References Cited

U.S. PATENT DOCUMENTS

| | | | |
|---|---|---|---|
| 3,838,588 | 10/1974 | Johnson | 72/114 |
| 4,248,077 | 2/1981 | Gregory | 72/453.17 |
| 4,604,889 | 8/1986 | Sukharevsky | 72/453.17 |
| 4,630,510 | 12/1986 | Belanger | 29/243.519 |
| 4,852,376 | 8/1989 | Subov | 29/243.53 |
| 5,035,353 | 7/1991 | Smart et al. | 72/391.6 |
| 5,207,085 | 5/1993 | Hopkins et al. | 72/391.6 |
| 5,371,933 | 12/1994 | Godfrey | 72/391.8 |
| 5,511,298 | 4/1996 | Gasser | 72/391.8 |

*Primary Examiner*—David Jones
*Attorney, Agent, or Firm*—Michael J. Striker

[57] ABSTRACT

An installation apparatus for an expansible anchor has a clamping piston guided in an expansion piston, both of which are perated by compressed air. The clamping piston has a clamping cone for a collet chuck. It slides on the collet chuck, which is fixed in the housing, and clamps a shank of the expansible anchor. The expansion piston displaces an expansible sleeve on the shank of the expansible anchor by an expansion plate which is screwed to the expansion piston and has a hole at its center, through which the shank of the expansible anchor projects into the collet chuck. The apparatus has the advantage of a closed force path as the expansible anchor is expanded, so that the anchor does not need to be steadied by a work-piece. In this manner, slabs or tiles having a small residual wall thickness at the bottom of a drilled hole are prevented from being damaged as the expansible anchor is installed.

6 Claims, 4 Drawing Sheets

APPARATUS FOR INSTALLING EXPANSIBLE ANCHORS

BACKGROUND OF THE INVENTION

The present invention relates to an apparatus for installing expansible anchors in drilled holes having an undercut.

Known expansible anchors have an expander head that enlarges, for example, conically, in a direction away from a shank. The anchor is introduced into a drilled hole having an undercut, which is in the form, for example of a hollow cone. By displacement of the expansible sleeve on the shank of the expansible anchor either the sleeve itself or an expansible part is pushed onto the expander head and is thereby expanded, with the result that the expansible anchor is anchored in the drilled hole with an interlocking fit. As the expansible sleeve or expansible part is pushed onto the expander head of the expansible anchor, the expansible anchor is pressed into the drilled hole and its expander head presses against the bottom of the drilled hole. As a consequence, slabs or tiles into which an expansible anchor is being installed may break at the bottom of the drilled hole in particular when the residual wall thickness there is slight.

SUMMARY OF THE INVENTION

Accordingly, it is an object of the present invention to provide an apparatus for installing an expansible anchor, which avoids the disadvantages of the prior art.

In keeping with these objects and with others which will become apparent hereinafter, one feature of the present invention resides, briefly stated in a apparatus for installing an expansible anchor, which has clamping means for clamping a shank of the expansible anchor, and expanding means movable in relation to said clamping means in a longitudinal direction of a clamp expansible anchor for displacing an expansible sleeve located on the shank of the expansible anchor towards an expander head of the expansible anchor in order to expand the expansible anchor.

When the apparatus is designed in accordance with the present invention the forces acting on a work-piece during installation of an expansible anchor, in particular the forces at the bottom of the drilled hole, are small, in order to avoid damage to the workpiece.

The apparatus according to the invention has a clamping device by means of which an expansible anchor is clamped by its shank. The clamped expansible anchor is inserted with its head as the leading end into a drilled hole having an undercut. By means of an expansion device the expansible sleeve is then displaced on the shank of the expansible anchor towards the expander head, the expansible anchor is consequently expanded and anchored in the drilled hole. During the expansion, the clamping device holds the expansible anchor against the force exerted on the expansible anchor by the expansible sleeve or the expansible part as this is being pushed onto the expander head. The expansible anchor is therefore not pressed into the drilled hole against the bottom of the drilled hole. The forces required for expansion are absorbed by the installation apparatus according to the invention and do not act in an outward direction on the work-piece.

When the installation apparatus is designed according to the invention, it has the advantage that during installation of an expansible anchor it effects a closed force path from the expansion device of the installation apparatus by way of the expansible sleeve to the expansible anchor and from there back to the clamping device of the installation apparatus. By means of the installation apparatus according to the invention, it is possible to install expansible anchors even in thin work-pieces where the residual wall thickness at the bottom of the drilled hole is small.

In accordance with another embodiment of the invention, the operation of the clamping device and/or expansion piston is effected by means of a fluid under pressure, preferably with compressed air. For that purpose the clamping device has a pressurizable clamping piston having a clamping cone. The clamping piston is provided with a bore with which it is displaceably guided on a collet chuck which serves to clamp the shank of the expansible anchor. When acted on by pressure, the clamping piston is displaced, its clamping cone moves onto a cone of the collet chuck and presses the collets thereof radially together to clamp the shank of the expansible anchor. The collet chuck is rigidly joined to a housing of the installation apparatus and does not move with the clamping piston. In this manner a reliably operating clamping device of simple construction having only one moving part, the clamping piston, is obtained.

In accordance with a further feature of the invention, the apparatus has a pressurizable expansion piston which displaces the expansible sleeve of the expansible anchor clamped in the clamping device towards the expander head of the anchor and thus expands the expansible anchor. A development of the invention provides an expansion piston having an axial bore which receives the clamping piston. The expansion piston encloses the clamping piston, the two piston being guided one inside the other so that they are displaceable axially with respect to one another. In this manner, a compact construction of the installation apparatus according to the invention is achieved. This embodiment of the invention has the further advantage that the clamping device and the expansion device act coaxially on the expansible anchor and, as a consequence, moments that occur as the anchor is being expanded act neither inside the installation apparatus nor on the anchor.

In the inventive apparatus, manipulation of the apparatus is facilitated by an excess pressure valve, which opens a duct to an expansion piston pressure chamber when a clamping pressure in a clamping piston pressure chamber is reached. That causes the expansible anchor first of all to be clamped and then to be expanded as a result of fluid under pressure being supplied to the clamping piston chamber.

The installation apparatus according to the invention can be used as a manually-operated apparatus and can also be integratedin an automatic installation apparatus for automatic installation of expansible anchors. The automatic installation apparatus is preferably used in a fully automatic drilling arrangement that provides work-pieces such as slabs and tiles with undercut drilled holes at predetermined locations. Drilling, and installation of expansible anchors, is in this manner effected exactly and quickly on one arrangement.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
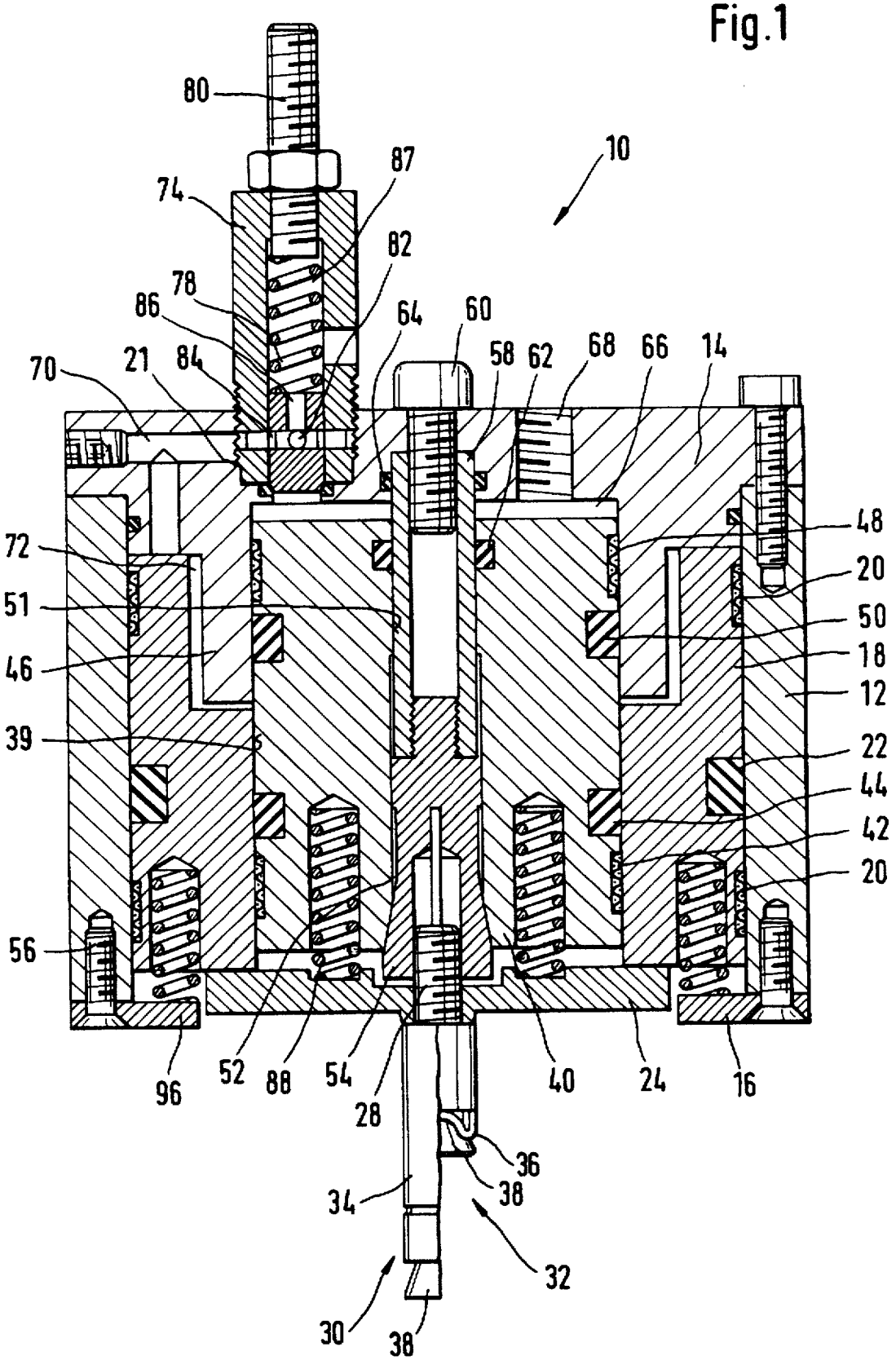
FIG. 1 is an axial section through an installation apparatus according to the invention.

An installation apparatus 10 according to the invention, illustrated in FIG. 1, has a hollow cylinder 12 with one end face sealed by a cover 14. The cover 14 is screwed to the hollow cylinder 12. The hollow cylinder 12 and the cover 14 form a housing of the installation apparatus 10. A flat stop ring 16 is screwed to the hollow cylinder 12 at an end face lying opposite the cover 14, and projects radially inwards a little beyond the hollow cylinder 12.

An expansion piston 18 is mounted in the hollow cylinder 12 so as to be displaceable axially. Circumferential guide bands 20 are inserted in two flat piston grooves close to the two ends of the expansion piston 18. The expansion piston 18 is sealed with respect to the hollow cylinder 12 by means of an O-ring 22 inserted in a piston groove.

A circular expansion plate 24 is screwed to the expansion piston 18 at the end face thereof facing towards the stop ring 16. The expansion plate 24 is located inside the stop ring 16. At its center, the expansion plate 24 is provided with a hole which allows a shank 28 of an expansible anchor 30, 32 to be pushed through (in FIG. 1, half of each of two types of expansible anchor 30, 32 are illustrated). At an edge of the hole, an expansible sleeve 34 that is displaceable on the shank 28 of the expansible anchor 30, 32 butts against the expansion plate 24. The expansible sleeve 34 serves to expand one of its own ends or of a separate expansible part 36 by means of an expander cone 38, which is one piece with the shank 28 of the expansible anchor 30, 32.

The expansion piston 18 is provided with an axial bore 39 in which a clamping piston 40 is received so as to be displaceable axially. The clamping piston has a circumferential guide band 42 which is inserted in a flat piston groove close to an end facing the expansion plate 24 and guides the clamping piston 40 in the expansion piston 18. By means of an O-ring 44 inserted in a piston groove the clamping piston 40 and the expansion piston 18 are sealed with respect to one another.

The expansion piston 40 has an end facing the cover 14, and guided in a hollow cylindrical extension 46. The extension 46 is in one piece with the cover 14 and projects axially into the hollow cylinder 12 by approximately less than one half the piston length. To guide it in the extension 46, a circumferential guide band 48 is inserted in a flat piston groove close to an end face of the clamping piston 40 facing the cover 14. The clamping piston 40 is sealed with respect to the extension 46 of the cover 14 by an O-ring 50, which is inserted in a piston groove.

In order to provide space for the hollow cylindrical extension 46 of the cover 14, the bore 39 in the expansion piston 18 is in the form of a stepped bore, which enlarges towards the cover 14. The extension 46 has, at least radially, a clearance with respect to the expansion piston 18.

The clamping piston 40 has an axial bore 51 which enlarges at an end facing the expansion plate 24 into an expander cone 52. A collect chuck 54 known per se having a cone is received in the bore 51 of the clamping piston 40. The collet chuck 54 is screwed to an internally threaded sleeve 58 which projects from the clamping piston 40 at the end nearest to the cover into a stepped bore of the cover 14. The threaded sleeve 58 is screwed to the cover 14 using a screw 60. The collect chuck 54 is rigidly screwed to the cover 14 by way of the threaded sleeve 58. The threaded sleeve is sealed with respect to the clamping piston 40 and the cover 14 by two O-rings f62, 64.

The cover 14 defines a clamping piston pressure chamber 66 inside its hollow cylindrical extension 46, the chamber being closed off by the clamping piston 40. A bore provided with a thread and acting as the compressed air connection 68 leads through the cover 14 into the clamping piston pressure chamber 66. A bore, turning twice through an angle, in the cover 14 leads, as fluid or compressed air connection 70 from the clamping piston pressure chamber 66, to an expansion piston pressure chamber 72. The expansion piston pressure chamber 72 is defined by the hollow cylinder 12, the cover 14, the expansion piston 18 and by the circumference of the clamping piston 40. An excess pressure valve 74 with a spring-loaded valve piston 76 is arranged in the compressed air duct 70. The spring bias of a valve spring 78, and consequently the opening pressure of the non-return valve 74, is adjustable by means of a threaded bolt 80. In its basic setting, the non-return valve 74 is closed, and blocks the compressed air duct 70 from the clamping piston pressure chamber 66 to the expansion piston pressure chamber 72.

The valve piston 76 is provided with two intersecting transverse bores 82 which open into a piston groove 84. From the intersection point of the transverse bore 82 an axial blind bore 86 leads axially to a valve chamber 87 that is in communication with its ambient area. Through the bores 82, 86 in the valve piston 76 and through the compressed air duct 70 the expansion piston pressure chamber 72 is in communication with the ambient area, that is to say, it is vented. The piston groove 84 of the valve piston 76 causes the transverse bores 82 of the valve piston 76 to communicate with the part of the compressed air duct 70 leading into the expansion piston pressure chamber 72, irrespective of the rotated position of the valve piston 76.

The installation apparatus 10 according to the invention functions as follows:

The shank 28 of an expansible anchor 30, 32 is introduced through the hole in the expansion plate 24 into the collet chuck 54. The clamping piston pressure chamber 66 is pressurized with compressed air through the compressed air connection 68, whereupon the clamping piston 40 moves towards the expansion plate 24. The clamping cone of the clamping piston 40 slides onto the cone 56 of the collet chuck 54 and presses the clamping collets thereof radially together, with the result that the shank 28 of the expansible anchor 30, 32 is clamped. The valve piston 76 closes the compressed air connection 70, and the collet chuck pressure chamber 66 is hermetically sealed. As soon as the pressure in the collet chuck pressure chamber 66 reaches and exceeds a clamping pressure adjustable by means of the threaded bolt 80 of the non-return valve 74, the spring-loaded valve piston 76 unblocks the compressed air duct 70 so that compressed air flows over from the collet chuck pressure chamber 66 into the expansion piston chamber 72. At the same time, the valve piston 76 blocks its transverse bores 82, so that the expansion piston pressure chamber 72 is closed off from its surroundings. The compressed air in the expansion piston chamber 72 moves the expansion piston until it meets the stop ring 16. As this occurs, the expansion ring 24 screwed to the expansion piston displaces the expansible sleeve 34 towards the expander head 38 of the expansible anchor 30, 32. The expansible sleeve 34 itself, or the expansible part 36, is anchored in a drilled hole, not illustrated, having, for example, a conical undercut.

Since the expansible anchor 30, 32 is clamped at its shank 28 in the collet chuck 54, the expansible anchor 30, 32 is not pressed against the bottom of a drilled hole as its expansible sleeve 34 is pushed onto its expander head 38. The force acting in the longitudinal direction of the expansible anchor 30, 32 as the expansible sleeve 34 is pushed onto the expander cone 38 is absorbed by the collet chuck 54 of the installation apparatus according to the invention.

Once the expansible anchor 30, 32 has been installed, the compressed air is let out of the clamping piston pressure chamber 66 through the compressed air connection 68. Helical pressure springs 88, which bear against the expansion plate 24, press the clamping piston 40 back into a starting position. As this takes place the collet chuck 54 opens so that the installation apparatus 10 according to the invention can be taken off the shank 28 of the expansible anchor 30, 32. The expansion piston pressure chamber 72 is vented through the excess pressure valve 74 as soon as the valve piston 76 thereof closes the compressed air duct 70 as the pressure in the clamping piston pressure chamber 66 eases. Helical pressure spring 96, which bear against the stop ring 16, press the piston 18 back into its starting position.

Figure 2:
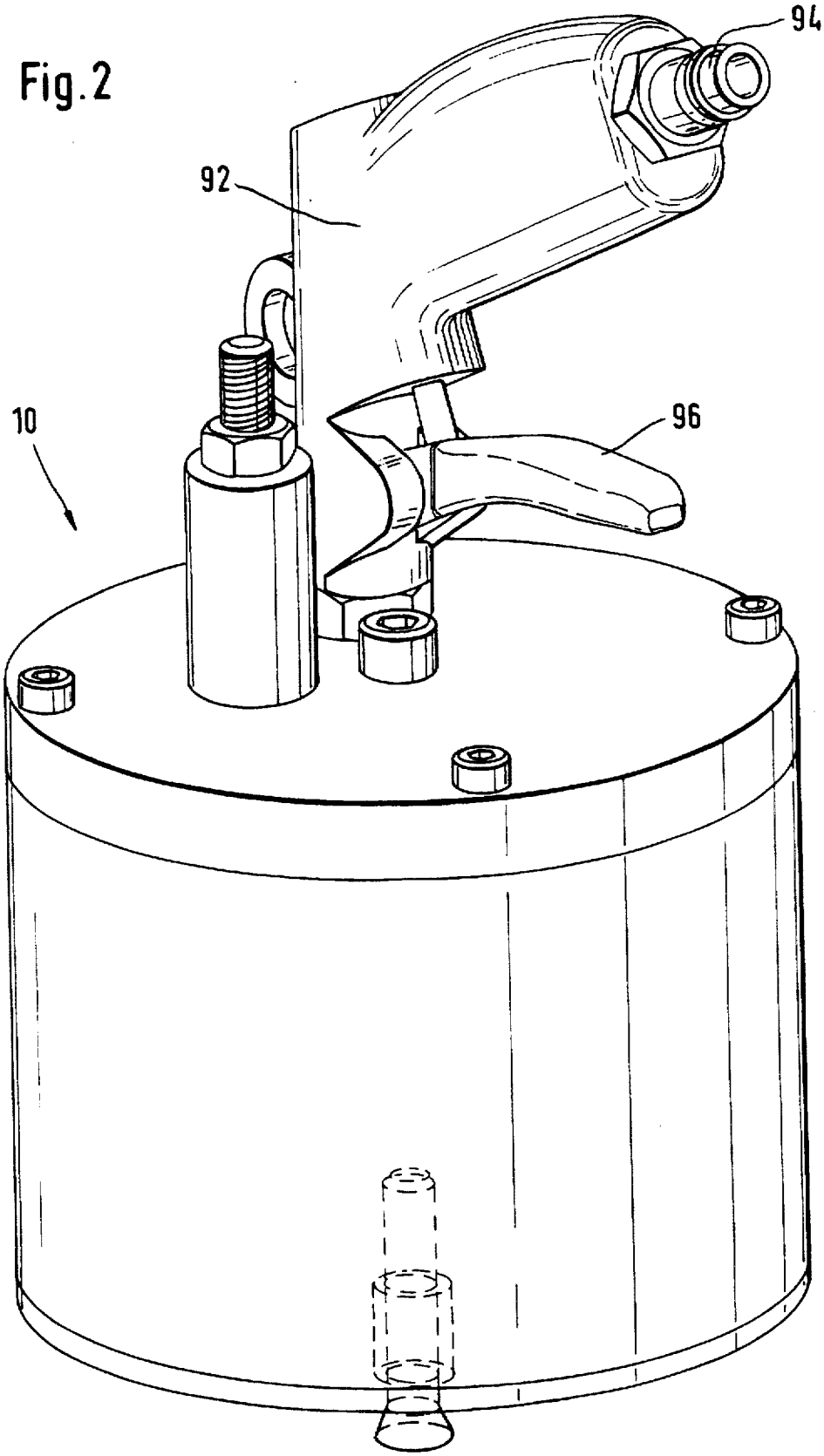
FIG. 2 is a perspective view of the installation apparatus from FIG. 1 with a handle mounted thereon.

In FIG. 2, the installation apparatus 10 according to the invention is illustrated with a handle 92 screwed into the compressed air connection 68, the handle being in the form of a pistol grip having a compressed air connection 94. A compressed air valve operable by means of a trigger 96 is integrated in the handle 92. When the trigger 96 is released, the installation apparatus 10 is vented.

Figure 3:
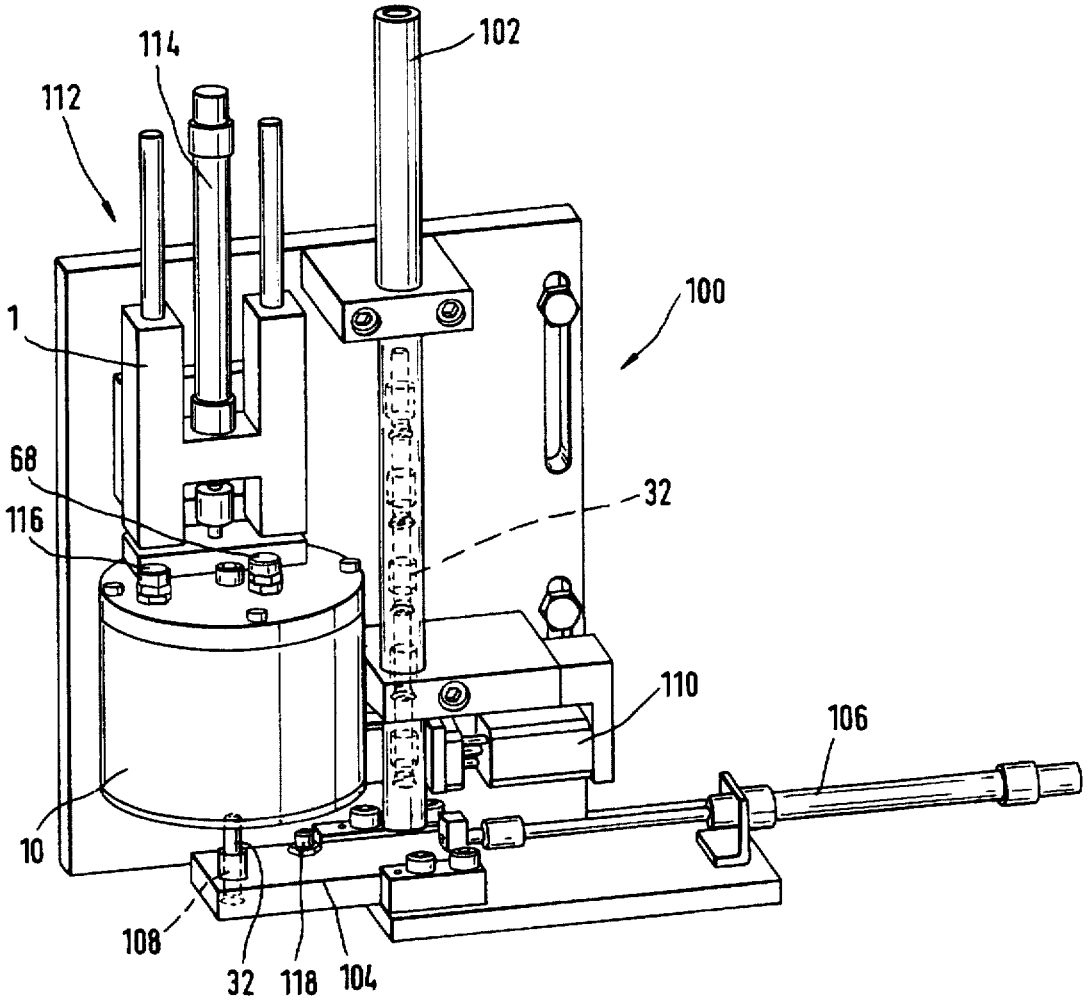
FIG. 3 shows an automatic installation apparatus including the installation apparatus from FIG. 1 according to the invention.

FIG. 3 shows the use of the installation apparatus 10 according to the invention in an automatic installation apparatus 100 for placing the anchoring expansible anchors in drilled holes. Laterally next to the installation apparatus 10 there is arranged a magazine 102 in the form of an upright tube which contains expansible anchors 32. Beneath an opening of the magazine 102 there is a slide 104 which is operable by pneumatic cylinder 106. A blind bore 108 in the slide 104 serves to receive an expansible anchor 32. The remaining expansible anchors 32 are tained in the magazine 10 by a pneumatically operated separating device 110. The installation apparatus 10 is held by means of a column guide 112 on the automatic installation apparatus 100 so as to be displaceable vertically, and is arranged to be driven by means of a pneumatic lifting cylinder 114 to perform a lifting movement.

By means of the lifting cylinder 114, the installation apparatus 10 is lowered onto the expansible anchor 32 and clamps this through supply of compressed air at the compressed air connection 68. The installatoin apparatus 10 is then raised by the lifting cylinder 114 again so that the expansible anchor 32 is removed from the blind bore 108 of the slide 104. The pneumatic cylinder 106 of the slide 104 moves the slide to the side, so that the installation apparatus 10 can be moved freely downwards. To expand the expansible anchor 32, compressed air acts on the expansion piston pressure chamber 72 through a second compressed air connection 116. The second compressed air connection 116 is screwed into the compressed air duct 70 in place of the non-return valve 74 and closes the duct to the clamping piston pressure chamber 66. Once the expansible anchor 32 has been installed, both pressure chambers 66, 72 are vented through the compressed air connections 68, 116 and the installation apparatus 10 is moved back into its starting position by the lifting cylinder 114. As the expansible anchor is being installed, the separating device 110 releases an expansible anchor 32 from the magazine 102 and this falls into the blind bore 108 of the slide 104 and is supplied to the installation apparatus 10 by displacing the slide 104. A height-adjustable stop 118 on the slide 104 defines the clamping depth of the expansible anchor in the installation apparatus 10 and in this mannre predetermines the displacement path of the expansible sleeve 34 on the expansible anchor 32.

Figure 4:
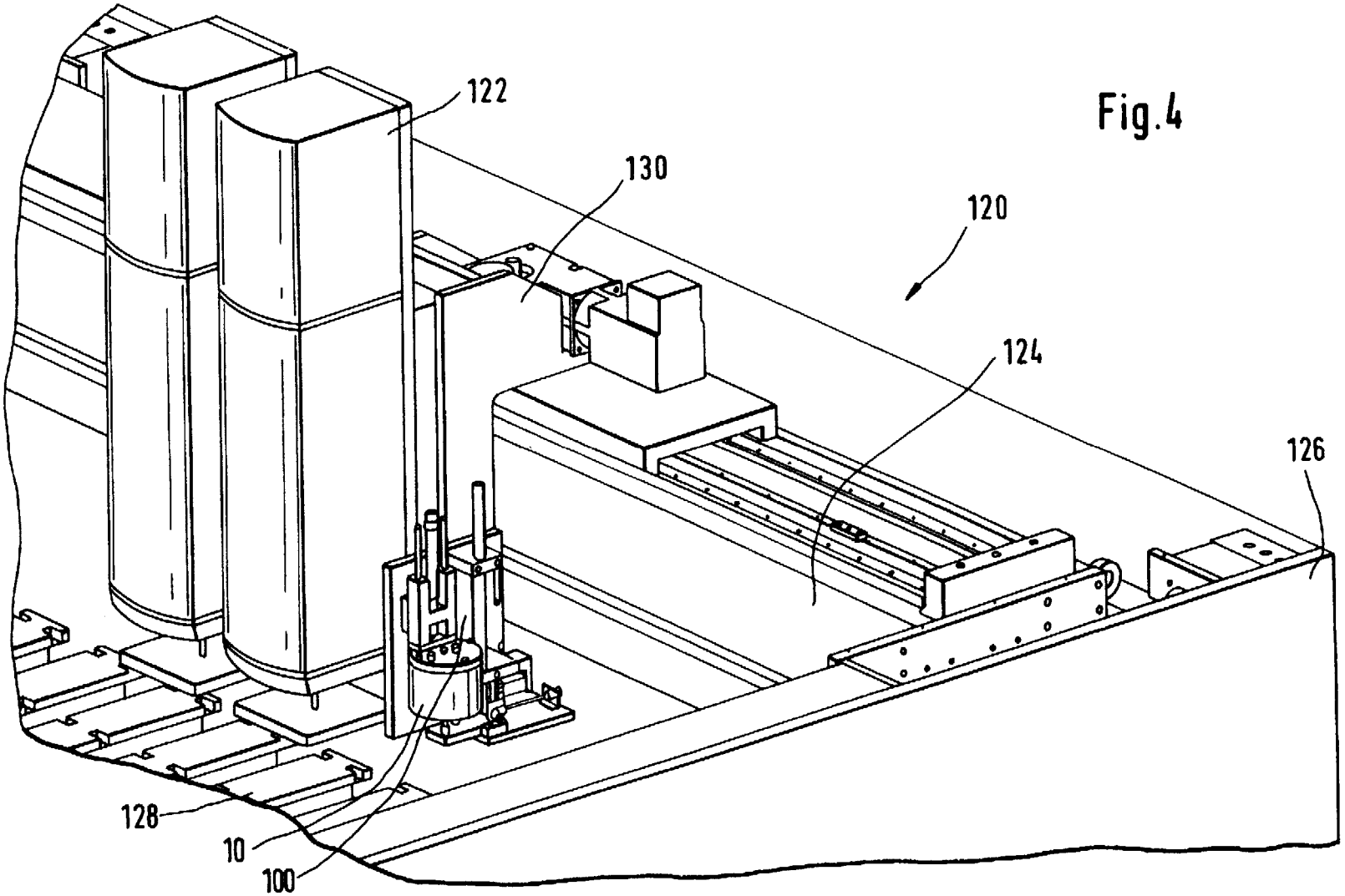
FIG. 4 shows the installation apparatus from FIG. 1 integrated in a fully automatic drilling arrangement.

FIG. 4 is a fragmentary view of an arrangement for making undercut drilled holes in slabes, tiles or similar arcticles and for installing expansible anchors in the drilled holes. The arrangement 120 comprises two drilling devices 122 known per se, which are drivably mounted on a cross rail 124. The cross rail 124 is in its turn drivable on a machine frame 126 of the arrangement 120 transversely t the direction in which the drilling devices 122 are driven. Workpieces, not illustrated, can be placed on a work surface 128 of the machine frame 126 beneath the drilling devices 122. The automatic installation apparatus 100 with the installation apparatus 10 according to the invention is mounted laterally on a carriage 130, on which the drilling devices 122 are also mounted, so that, after drilling, the apparatus can be moved into the correct position over the holes and expansible anchors can be installed by means of the installation device 10. The arrangement 120 is preferably fully automatically computer-operated.

It will be understood that each of the elements described above, or two or more together, may also find a useful application in other types of constructions differing from the types described above.

While the invention has been illustrated and described as embodied in device for installing expansible anchors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for installing an expansible anchor having a shank, an expander head and an expansible sleeve, the apparatus comprising clamping means for clamping the shank of the expansible anchor; expanding means movable in the relation to said clamping means in a longitudinal direction of the clamped expansible anchor for displacing the expansible sleeve located on the shank towards the expander head in order to expand the expansible anchor., said collet chuck having a cone, said clamping means further including an expander cone which is arranged to be pushed onto said cone of said collet chuck, said collet chuck having a shank, said clamping means including a pressurizable clamping piston which is displaceably guided on said shank of said collet chuck and displacing said cone of said collet chuck.

2. An apparatus as defined in claim 1, wherein said clamping means includes a collet chuck.

3. An apparatus for installing an expansible anchor having a shank, an expander head and an expansible sleeve, the apparatus comprising clamping means for clamping the shank of the expansible anchor; expanding means movable in the relation to said clamping means in a longitudinal direction of the clamped expansible anchor for displacing the expansible sleeve located on the shank towards the expander head in order to expand the expansible anchor, said expanding means including a pressurizable expansion piston for displacing the expansible sleeve toward the expander head of the expansible anchor, said expansion piston having a bore, and said clamping means having a clamping piston which is received in said bore.

4. An apparatus for installing an expansible anchor having a shank, an expander head and an expansible sleeve, the apparatus comprising clamping means for clamping the shank of the expansible anchor; expanding means movable in the relation to said clamping means in a longitudinal direction of the clamped expansible anchor for displacing the expansible sleeve located on the shank towards the expander head in order to expand the expansible anchor, said clamping means including a clamping piston and a clamping piston pressure chamber, said expanding means including an expansion piston and an expansion piston pressure chamber; and further comprising a fluid duct that leads from said clamping piston pressure chamber to said expansion piston pressure chamber; and an excess pressure valve provided in said fluid duct and opening said fluid duct when a clamping pressure in said clamping piston pressure chamber is reached.

5. An apparatus as defined in claim 4, wherein said excess pressure valve is formed so that in a basic setting it vents said expansion piston pressure chamber.

6. An automatic installation system for an expansible anchor having a shank, an expander head, and an expansible anchor, the system comprising an installation apparatus including clamping means for clamping the shank of the expansible anchor, and expanding means movable relative to said clamping means in a longitudinal direction of the expansible anchor for displacing the expansible sleeve located on the shank toward the expander head in order to expand the expansible anchor; lifting means for said installation apparatus; and a separating and feeding device for removing the expansible anchor from a magazine and feeding it to said installation apparatus.

* * * * *